US011817044B1

(12) United States Patent
Cao et al.

(10) Patent No.: US 11,817,044 B1
(45) Date of Patent: Nov. 14, 2023

(54) PIXEL DRIVING CIRCUIT AND DISPLAY PANEL

(71) Applicant: WUHAN CHINA STAR OPTOELECTRONICS TECHNOLOGY CO., LTD., Hubei (CN)

(72) Inventors: Haiming Cao, Hubei (CN); Chao Tian, Hubei (CN); Fei Ai, Hubei (CN); Guanghui Liu, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 18/050,935

(22) Filed: Oct. 28, 2022

(30) Foreign Application Priority Data

Oct. 11, 2022 (CN) ..... 202211243974.3

(51) Int. Cl.
*G09G 3/32* (2016.01)

(52) U.S. Cl.
CPC ..... *G09G 3/32* (2013.01); *G09G 2300/0852* (2013.01); *G09G 2310/027* (2013.01); *G09G 2320/0233* (2013.01); *G09G 2320/0633* (2013.01)

(58) Field of Classification Search
CPC ..... G09G 3/32; G09G 2300/0852; G09G 2310/027; G09G 2320/0233; G09G 2320/0633
See application file for complete search history.

(56) References Cited

U.S. PATENT DOCUMENTS

2017/0270850 A1* 9/2017 Pappas ..... G09G 3/2077
2019/0306945 A1* 10/2019 Valentine ..... G09G 3/32
2020/0312216 A1* 10/2020 Kim ..... G09G 3/32

* cited by examiner

*Primary Examiner* — Andrew Sasinowski
(74) *Attorney, Agent, or Firm* — PV IP PC; Wei Te Chung; Zhigang Ma

(57) ABSTRACT

The present application provides a pixel driving circuit and a display panel. The pixel driving circuit includes an amplitude regulating module and a pulse width modulation module, where the amplitude regulating module and the pulse width modulation module are both electrically connected to a first node, so that the pulse width modulation module and the amplitude modulation module are configured to cooperate with a first data signal and a second data signal, respectively, to realize regulation of both the pulse width and the amplitude of the valid pulse of the driving current signal for driving the light emitting device to emit light. As such, the valid pulse of the driving current signal has different pulse widths and different amplitudes under correspondingly different gray scale states, so that the light emitting brightness and the light emitting duration of the light emitting device under correspondingly different gray scale states are different.

14 Claims, 13 Drawing Sheets

PIXEL DRIVING CIRCUIT AND DISPLAY PANEL

CROSS-REFERENCE TO RELATED APPLICATION

This application claims priority to and the benefit of Chinese Patent Application No. 202211243974.3, filed on Oct. 11, 2022, the entire content of which is hereby incorporated by reference.

TECHNICAL FIELD

The present application relates to the field of display technologies, and more particularly to a pixel driving circuit and a display panel.

BACKGROUND

In a display panel, display of a picture can be realized by using a light emitting diode as a sub-pixel. However, there are problems of the lower light emission efficiency and the worse brightness uniformity in realizing a low gray scale display.

SUMMARY

Embodiments of the present application provide a pixel driving circuit and a display panel, so as to improve problems of the lower light emission efficiency and the worse brightness uniformity in realizing the low gray scale display.

An embodiment of the present application provides a pixel driving circuit, including: an amplitude regulating module and a pulse width modulation module. The pulse width modulation module is electrically connected to a first data line, a first node, and a modulation signal source and configured to control a pulse width of a valid pulse of a driving current signal for driving a light emitting device to emit light. The amplitude regulating module is electrically connected to a second data line and the first node and configured to an amplitude of the valid pulse of the driving current signal. The valid pulse of the driving current signal has different pulse widths and different amplitudes in correspondingly different gray scale states.

Another embodiment of the present application further provides a display panel, including a pixel driving circuit of any of the foregoings.

The present application provides the pixel driving circuit and the display panel. The pixel driving circuit includes the amplitude regulating module and the pulse width modulation module. The amplitude regulating module and the pulse width modulation module are both electrically connected to the first node, so that the pulse width modulation module and the amplitude modulation module are configured to cooperate with a first data signal and a second data signal, respectively, to realize regulation of both the pulse width and the amplitude of the valid pulse of the driving current signal for driving the light emitting device to emit light. As such, the valid pulse of the driving current signal has different pulse widths and different amplitudes under correspondingly different gray scale states, so that the light emitting brightness and the light emitting duration of the light emitting device under correspondingly different gray scale states are different, thereby improving the light emitting efficiency and the light emitting uniformity of the light emitting device.

Therefore, the display picture can enable a gray scale difference of display. The display panel includes the pixel driving circuit.

BRIEF DESCRIPTION OF THE DRAWINGS

In order to more clearly illustrate the technical solutions in embodiments of the present application, the accompanying drawings depicted in the description of the embodiments will be briefly described below. It will be apparent that the accompanying drawings in the following description are merely some embodiments of the present application, and other drawings may be obtained from these drawings without creative effort by those skilled in the art.

EMBODIMENTS OF THE PRESENT DISCLOSURE

Figure 1A:
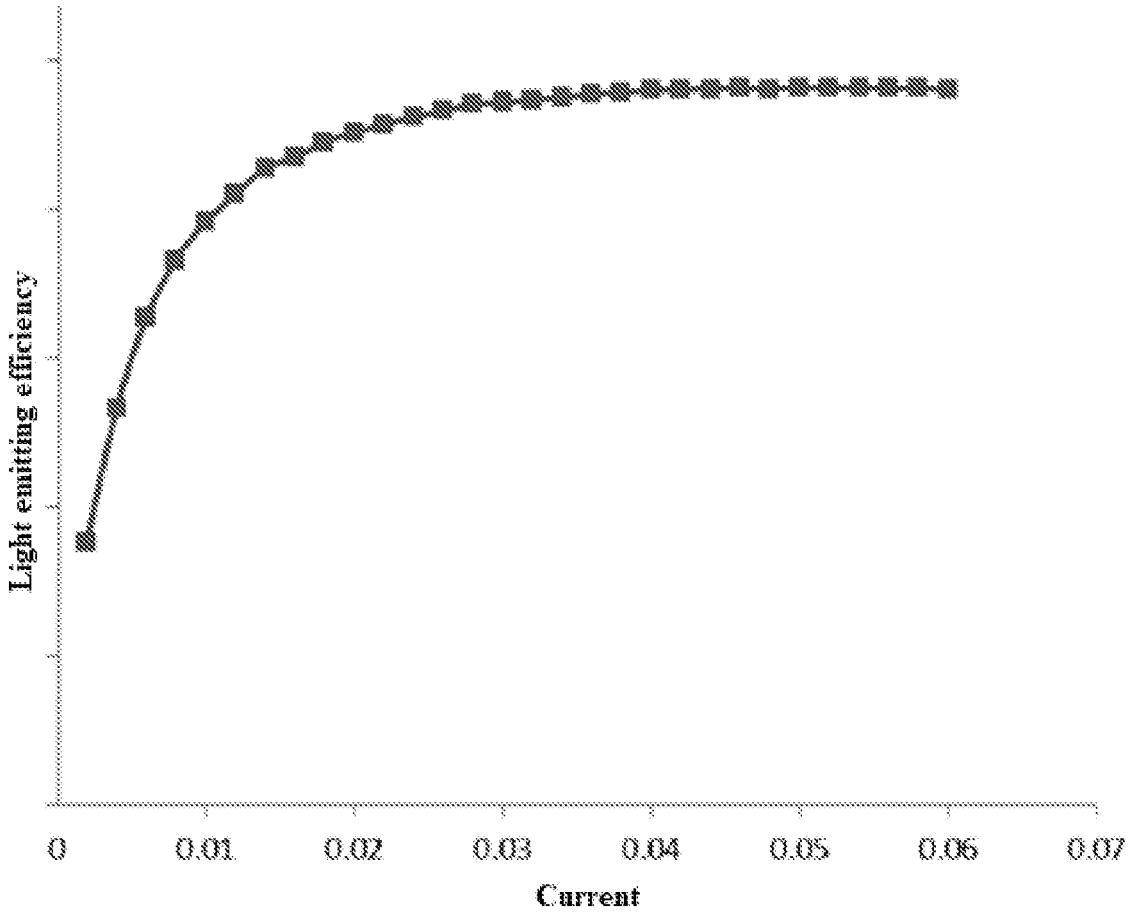
FIG. 1A is a graph of change of a light emitting efficiency of a light emitting device with a current.

Technical solutions in embodiments of the present application will be clearly and completely described below in conjunction with drawings in the embodiments of the present application. Obviously, the described embodiments are only a part of embodiments of the present application, rather than all the embodiments. Any ordinarily skilled person in the technical field of the present application could still obtain other accompanying drawings without use laborious invention based on the present accompanying drawings. In addition, it should be understood that the specific implementations described here are only used to illustrate and explain the present application, and are not used to limit the present application. In the present application, unless otherwise stated, directional words used such as "upper" and "lower" generally refer to the upper and lower directions of the device in actual use or working state, and specifically refer to the drawing directions in the drawings; and "inner" and "outer" refer to the outline of the device.

Specifically, FIG. 1A is a graph of change of a light emitting efficiency of a light emitting device with a current. As can be seen from FIG. 1A, the light emitting efficiency of the light emitting device is decreased rapidly at a low driving current. Therefore, in order to realize the required light emission efficiency, it is necessary to increase the driving current, whereby increasing the power consumption. Moreover, brightness uniformity may be also deteriorated at the low driving current, which may cause a problem of worse display uniformity.

Figure 1B:
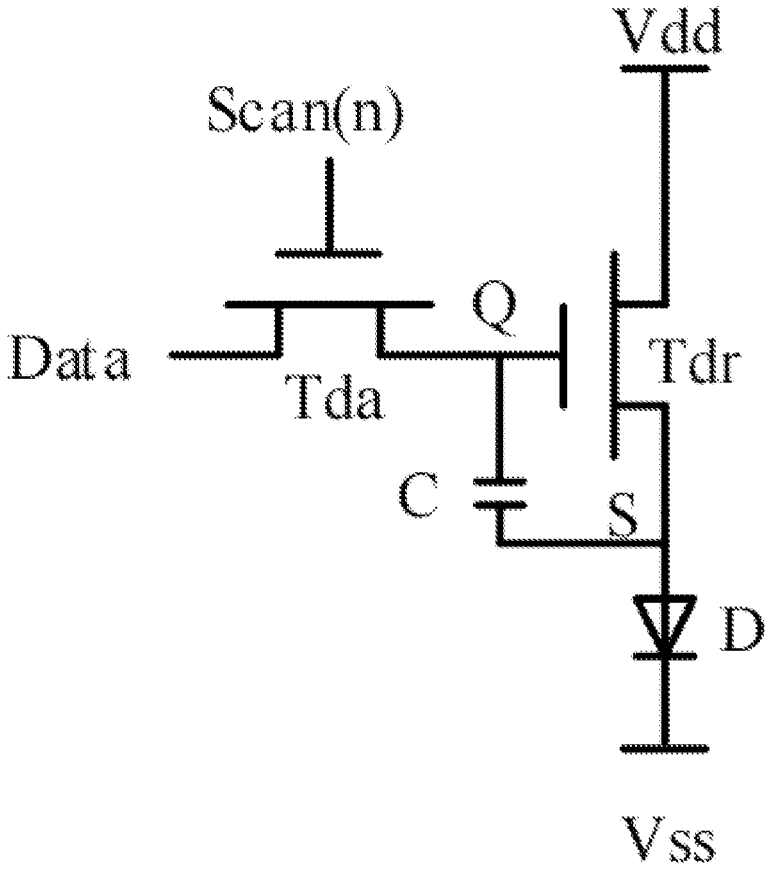
FIG. 1B is a schematic diagram of a structure of a pixel driving circuit in the prior art.

FIG. 1B is a schematic diagram of a structure of a pixel driving circuit in the prior art, where the pixel driving circuit includes a driving transistor Tdr, a data writing transistor Tda, and a capacitor C. By controlling a voltage value of a data signal Data transmitted by a data line DaL, a voltage difference between a gate and a source of the driving transistor Tdr can be changed, to control the magnitude of the driving current, thereby changing the luminous brightness of the light emitting device D and realizing a gray scale difference of display. However, when the pixel driving circuit shown in FIG. 1B is used to drive the light emitting device D to emit light, the driving current in the low gray-scale state is still relatively low, so that the problems of low light emitting efficiency and worse brightness uniformity cannot be avoided.

FIGS. 2A-2F are schematic diagrams of structures of pixel driving circuits according to embodiments of the present application. The present application provides a pixel driving circuit including a pulse width modulation module 100 and an amplitude regulating module 200.

The pulse width modulation module 100 is electrically connected to a first data line DL1, a first node Q1, and a modulation signal source Sweep, and configured to control a pulse width of a valid pulse of a driving current signal Id for driving the light emitting device D to emit light based on a difference in voltages between a modulation signal Sw generated by the modulation signal source Sweep and a first data signal Data1 transmitted by the first data line DL1. The amplitude regulating module 200 is electrically connected to a second data line DL2 and the first node Q1, and configured to control an amplitude of the valid pulse of the driving current signal Id based on a second data signal Data2 transmitted by the second data line DL2.

The amplitude regulating module 200 may enable the valid pulse of the driving current signal Id to have different amplitudes under correspondingly different gray scale states and the pulse width modulation module 100 may enable the valid pulse of the driving current signal Id to have different pulse widths under correspondingly different gray scale states, so that the light emitting brightness and the light emitting duration of the light emitting device under correspondingly different gray scale states are different, thereby improving the light emitting efficiency and the light emitting uniformity of the light emitting device.

Figure 2A:
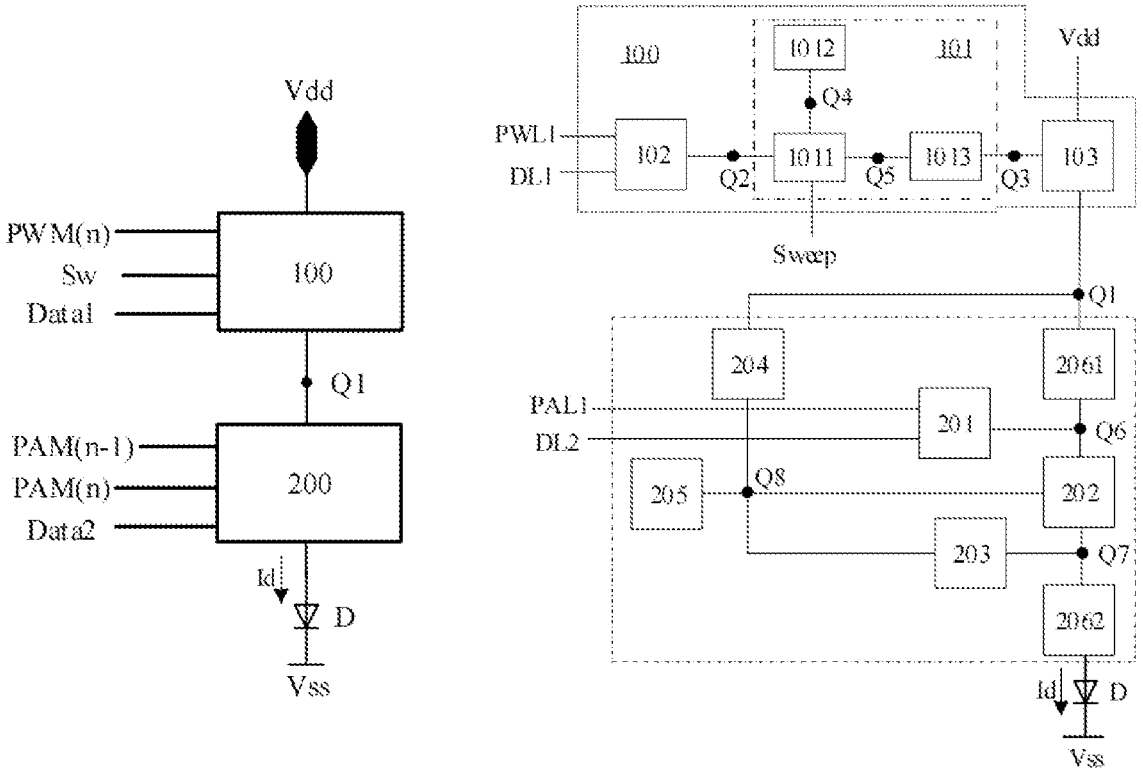
FIG. 2A is a schematic diagram of a structure of a pixel driving circuit according to an embodiment of the present application.
Figure 2B:
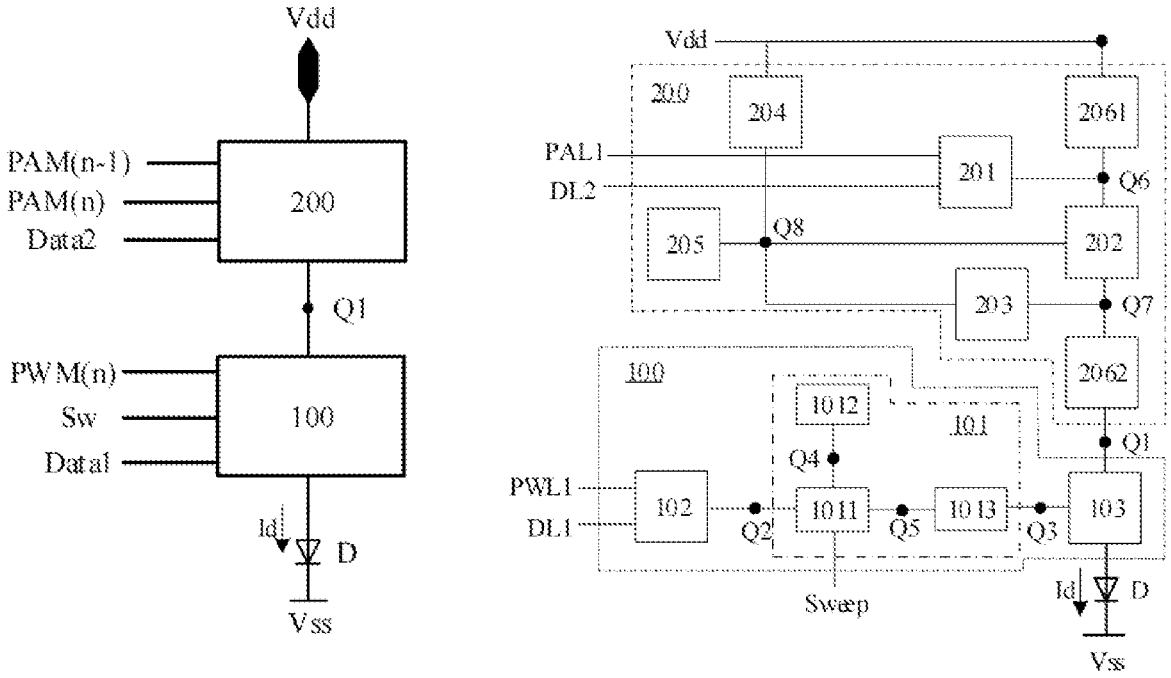
FIG. 2B is a schematic diagram of a structure of a pixel driving circuit according to an embodiment of the present application.

Alternatively, the amplitude regulating module 200 and the pulse width modulation module 100 are connected in series between a first power supply terminal Vdd and the light emitting device D. If the pulse width modulation module 100 is electrically connected between the first power supply terminal Vdd and the first node Q1, the amplitude regulating module 200 is electrically connected between the first node Q1 and an anode of the light emitting device D, and a cathode of the light emitting device D is electrically connected to a second power supply terminal Vss, as shown in FIG. 2A. Alternatively, if the amplitude control module 200 is electrically connected between the first power supply terminal Vdd and the first node Q1, the pulse width modulation module 100 is electrically connected between the first node Q1 and the anode of the light emitting device D, and the cathode of the light emitting device D is electrically connected to the second power supply terminal Vss, as shown in FIG. 2B.

Alternatively, continuing to refer to FIGS. 2A-2F, the pulse width modulation module 100 includes a data conversion unit 101. The data conversion unit 101 is electrically connected to a second node Q2 and a third node Q3, and configured to generate a current driving control signal based on a voltage difference between a modulation signal Sw and a first data signal Data1, and transmitting the current driving control signal to the third node Q3.

Alternatively, the data conversion unit 101 includes a current mirror unit 1011. The current mirror unit 1011 is electrically connected to the second node Q2, a fourth node Q4, a fifth node Q5, a modulation signal source Sweep, for outputting a current pulse width modulation signal based on a voltage difference between a modulation signal Sw generated by the modulation signal source Sweep and a first data signal Data1 received by the second node Q2, and outputting the current pulse width modulation signal to a fifth node Q5.

Alternatively, the current mirror unit 1011 includes a first transistor T1, a second transistor T2, a third transistor T3, and a fourth transistor T4.

A gate of the first transistor T1 is electrically connected to the modulation signal source Sweep, and a source and a drain of the first transistor T1 are electrically connected between the fourth node Q4 and the fifth node Q5. A gate of the second transistor T2 is electrically connected to the second node Q2, and one of a source and a drain of the second transistor T2 is electrically connected to the fourth node Q4. A gate of the third transistor T3 is electrically connected to another one of the source and the drain of the second transistor T2, and a source and a drain of the third transistor T3 are electrically connected between another one of the source and the drain of the second transistor T2 and a third power supply terminal Switch_L. A gate of the fourth transistor T4 is electrically connected to another one of the source and the drain of the second transistor T2, and a source and a drain of the fourth transistor T4 are electrically connected between the fifth node Q5 and the third power supply terminal Switch_L.

Alternatively, the fourth node Q4 may be connected to a constant power supply. Alternatively, the data conversion unit 101 further includes a current source unit 1012 electrically connected to the fourth node Q4.

Alternatively, the current source unit includes a fifth transistor T5, where a gate of the fifth transistor T5 is electrically connected to a fourth power supply terminal Vs, a source and a drain of the fifth transistor T5 are electrically connected between a fifth power supply terminal Switch_H and the fourth node Q4, and the fifth transistor T5 is configured to transmit a fifth power supply signal transmitted from the fifth power supply terminal Switch_H to the fourth node Q4.

Alternatively, the fifth transistor T5 is a P-type transistor or an N-type transistor. The fifth transistor T5 is a silicon transistor or an oxide transistor. Further, the fifth transistor T5 is a P-type transistor. Since a voltage difference between the gate and the source of the fifth transistor T5 is the difference between the fourth power supply signal transmitted from the fourth power supply terminal Vs and the fifth power supply signal transmitted from the fifth power supply terminal Switch_H, a current flowing through the fifth node Q5 is relatively stable, facilitating operation of the pixel driving circuit.

Alternatively, the data conversion unit 101 further includes a signal correction unit 1013. The signal correction unit 1013 is electrically connected to the fifth node Q5 and the third node Q3, and configured to generate a current driving control signal based on the current pulse width modulation signal and transmitting the current driving control signal to the third node Q3.

Alternatively, the signal correction unit 1013 includes a sixth transistor T6 and a seventh transistor T7. A gate of the sixth transistor T6 is electrically connected to the fifth node Q5, and a source and a drain of the sixth transistor T6 are electrically connected between the third power supply terminal Switch_L and the third node Q3 and configured to transmit the third power supply signal transmitted from the third power supply terminal Switch_L to the third node Q3 based on the current pulse width modulation signal. A gate of the seventh transistor T7 is electrically connected to the fifth node Q5, and a source and a drain of the seventh transistor T7 are electrically connected between a sixth power supply terminal Inv_H and the third node Q3 and configured to transmit a sixth power supply signal transmitted from the sixth power supply terminal Inv_H to the third node Q3 based on the current pulse width modulation signal. The sixth transistor T6 and the seventh transistor T7 generate a current driving control signal in conjunction with the third power supply signal and the sixth power supply signal under the action of the current pulse width modulation signal.

Alternatively, continuing to refer to FIGS. 2A-2F, the pulse width modulation module 100 further includes a first data writing unit 102 electrically connected to the first data line DL1 and the second node Q2 and configured to transmit the first data signal Data1 to the second node Q2.

Alternatively, the first data writing unit 102 includes an eighth transistor T8, where a gate of the eighth transistor T8 is electrically connected to a first control line PWL1, a source and a drain of the eighth transistor T8 are electrically connected between the second node Q2 and the first data line DL1, and the eighth transistor T8 is configured to transmit the first data signal Data1 transmitted by the first data line DL1 to the second node Q2 based on a first control signal PWM(n) transmitted by the first control line PWL1.

Alternatively, the first data writing unit further includes a first capacitor C1 connected in series between the second node Q2 and the second power supply terminal Vss for maintaining the potential of the second node Q2.

Alternatively, the pulse width modulation module 100 further includes a first current driving unit 103 electrically connected to the third node Q3, the first node Q1, and a light emitting device D, as shown in FIG. 2B. Alternatively, the first current driving unit 103 is electrically connected to the third node Q3, the first node Q1, and the first power supply terminal Vdd, as shown in FIG. 2A.

Figure 2C:
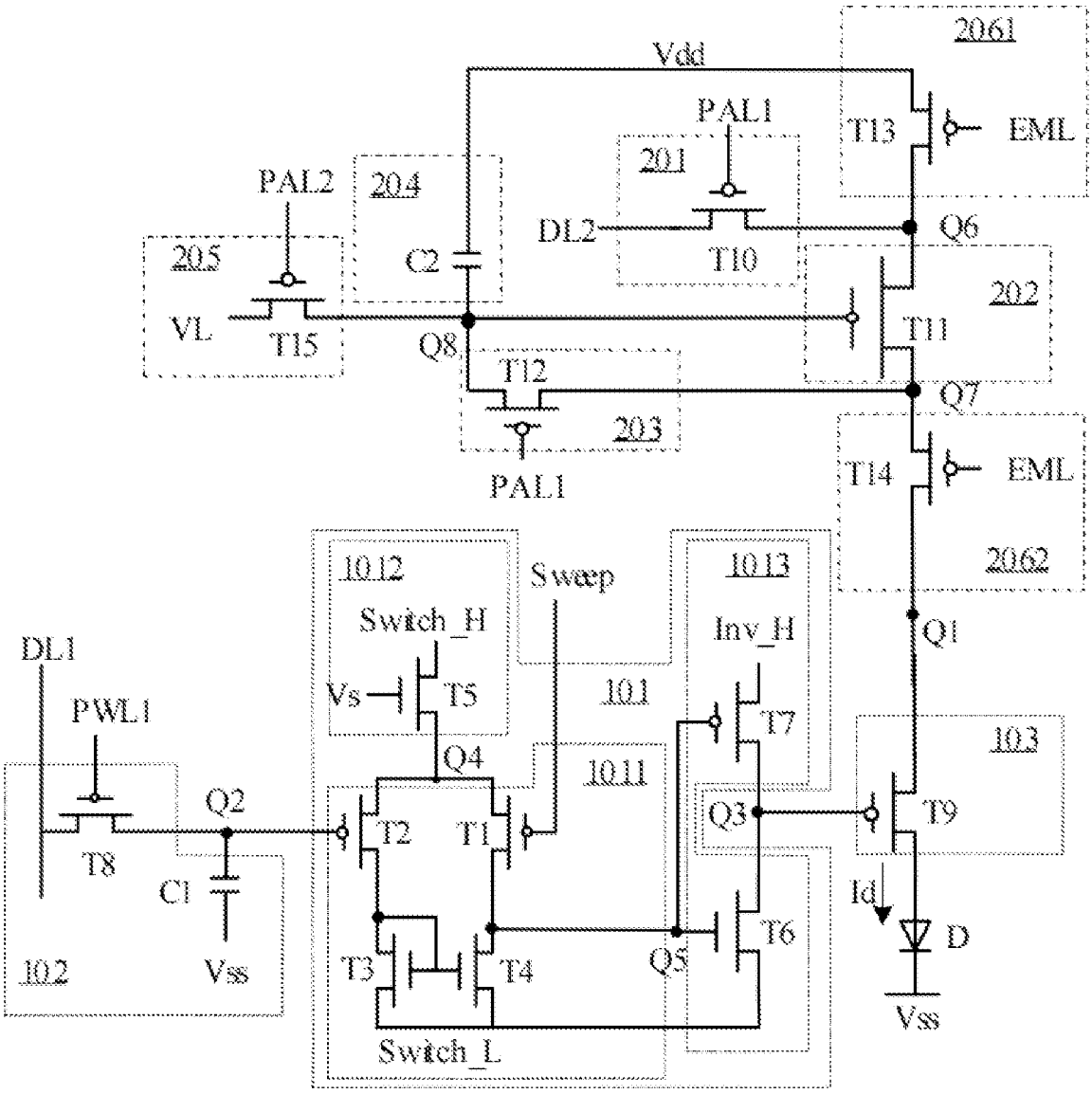
FIG. 2C is a schematic diagram of a structure of a pixel driving circuit according to an embodiment of the present application.
Figure 2D:
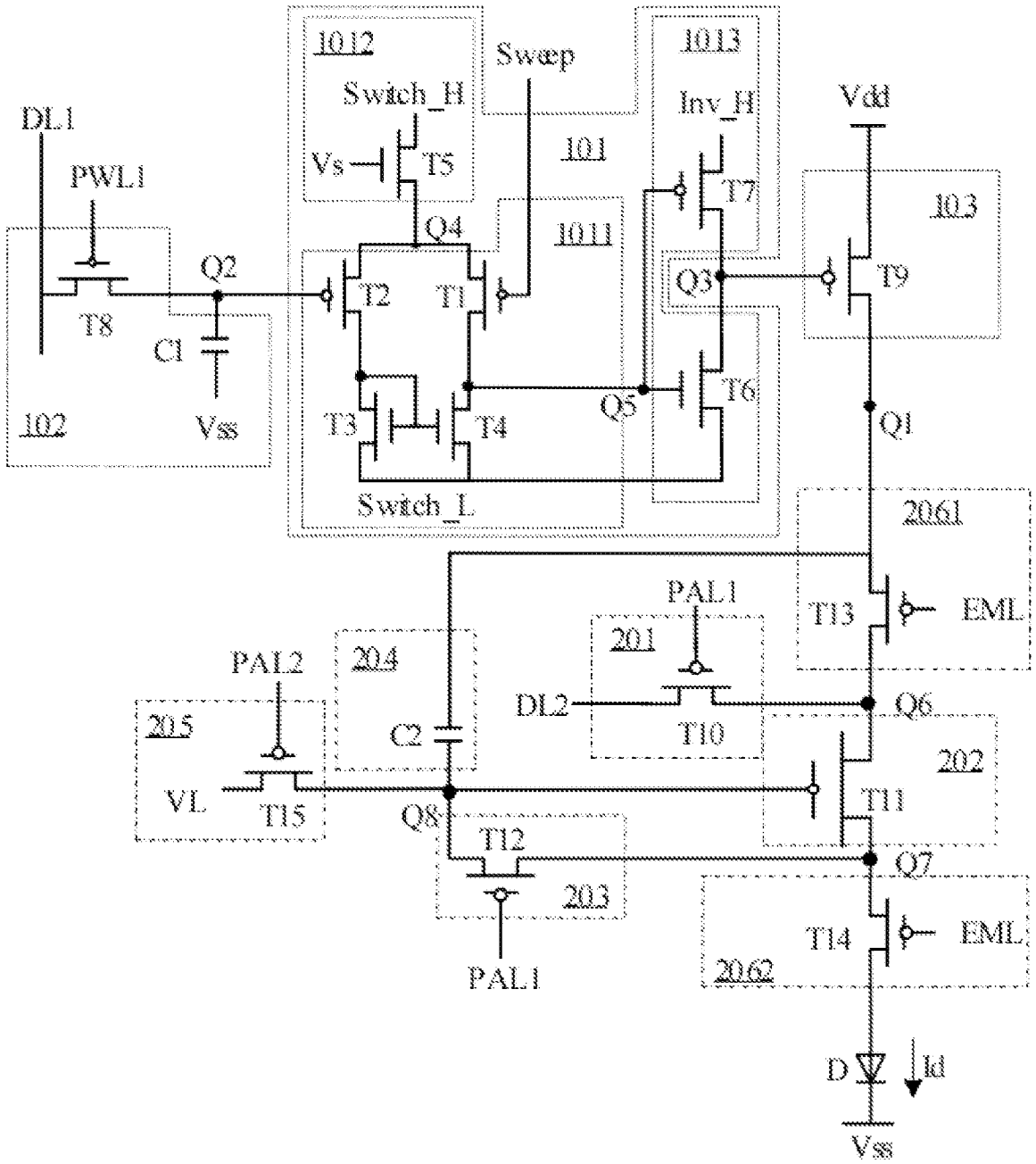
FIG. 2D is a schematic diagram of a structure of a pixel driving circuit according to an embodiment of the present application.
Figure 2E:
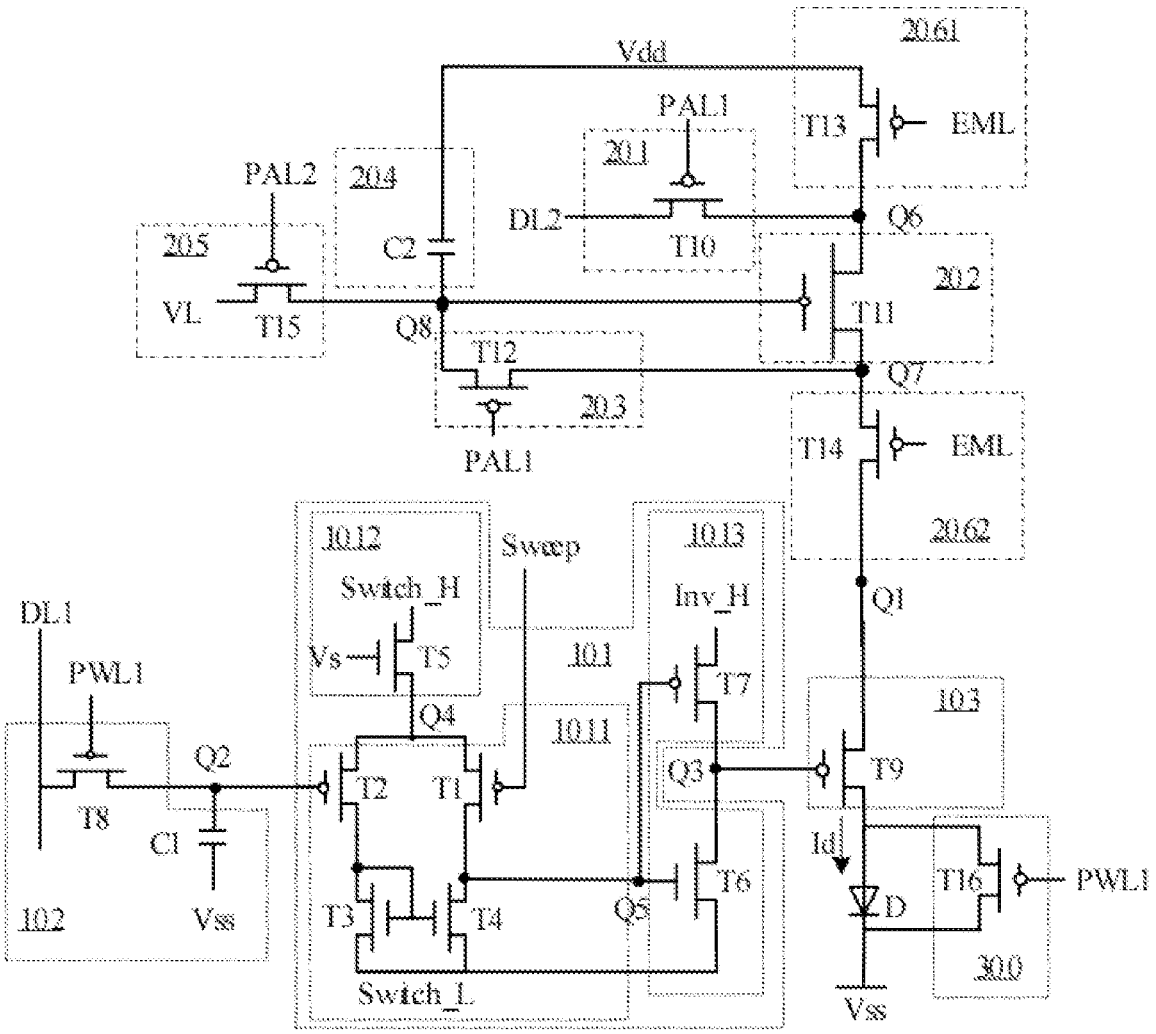
FIG. 2E is a schematic diagram of a structure of a pixel driving circuit according to an embodiment of the present application.
Figure 2F:
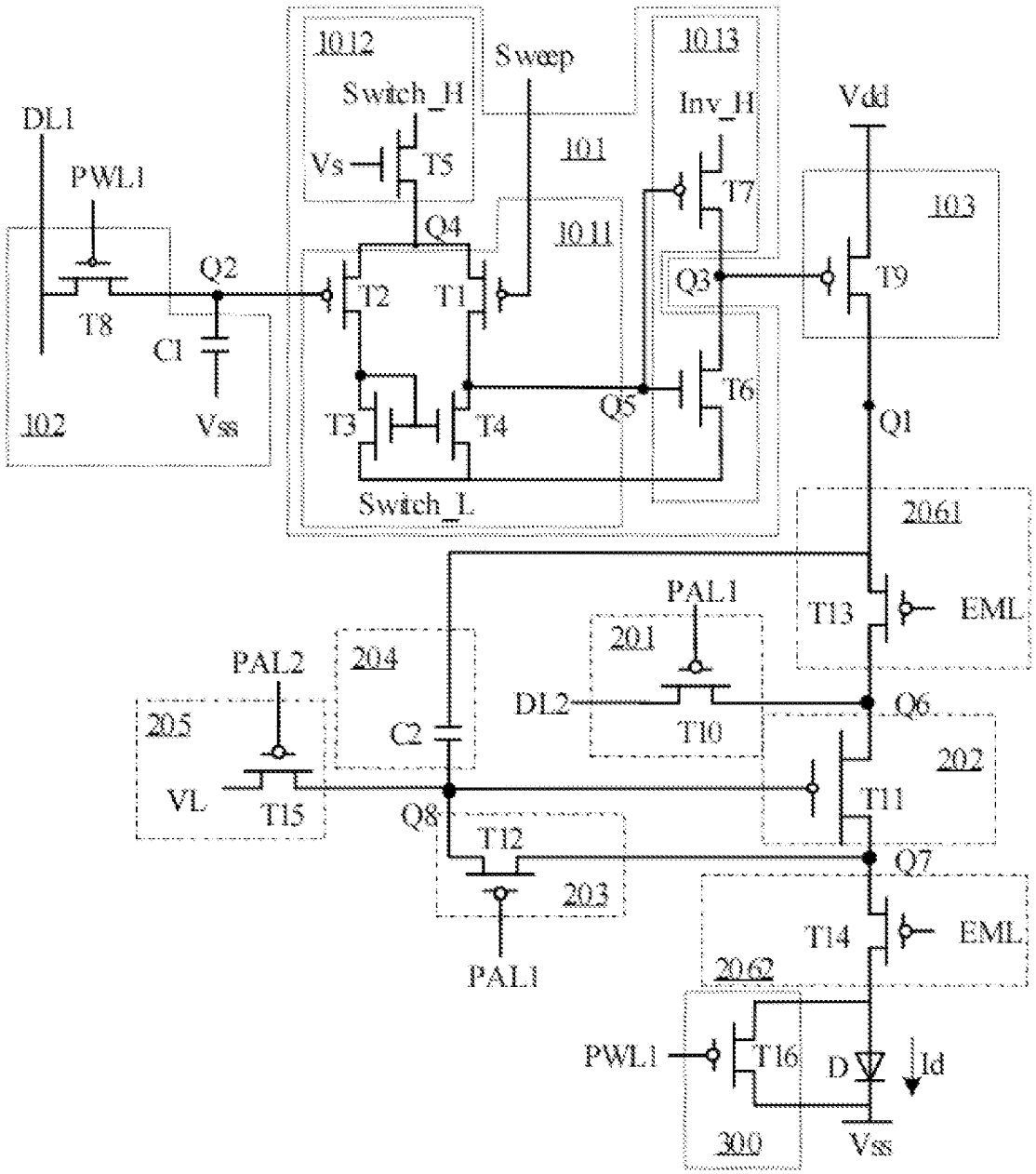
FIG. 2F is a schematic diagram of a structure of a pixel driving circuit according to an embodiment of the present application.

Alternatively, the first current driving unit 103 includes a ninth transistor T9, where a gate of the ninth transistor T9 is electrically connected to the third node Q3, and a source and a drain of the ninth transistor T9 is electrically connected between the first node Q1 and the light emitting device D, as shown in FIGS. 2C and 2E. Alternatively, the source and drain of the ninth transistor T9 are electrically connected between the first node Q1 and the first power supply terminal Vdd, as shown in FIGS. 2D and 2F.

Alternatively, continuing to refer to FIGS. 2A-2F, the amplitude regulating module 200 includes a second data writing unit 201, a second current driving unit 202, a threshold voltage compensation unit 203, a storage unit 204, a first reset unit 205, and a switching unit.

The second data writing unit 201 is electrically connected to the second data line DL2 and the sixth node Q6, and configured to transmit the second data signal Data2 transmitted from the second data line DL2 to the sixth node Q6. Alternatively, the second data writing unit 201 includes a tenth transistor T10, where a gate of the tenth transistor T10 is electrically connected to a second control line PALL and a source and a drain of the tenth transistor T10 are electrically connected between the second data line DL2 and the sixth node Q6. The tenth transistor T10 is configured to transmit the second data signal Data2 transmitted by the second data line DL2 to the sixth node Q6 based on the second control signal PAM(n) transmitted by the second control line PAL1.

The second current driving unit 202 is electrically connected to the sixth node Q6, the seventh node Q7, and the eighth node Q8, and configured to control the amplitude of the driving current signal Id based on the second data signal Data2. Alternatively, the second current driving unit 202 includes an eleventh transistor T11 where, a gate of the eleventh transistor T11 is electrically connected to the eighth node Q8, and a source and a drain of the eleventh transistor T11 are electrically connected between the sixth node Q6 and the seventh node Q7.

The threshold voltage compensation unit 203 is electrically connected to the seventh node Q7 and the eighth node Q8, and configured to transmit the second data signal Data2 having a compensation threshold voltage function to the eighth node Q8. Alternatively, the threshold voltage compensation unit 203 includes a twelfth transistor T12, where a gate of the twelfth transistor T12 is electrically connected to the second control line PAL1, and a source and a drain of the twelfth transistor T12 are electrically connected between the seventh node Q7 and the eighth node Q8.

The storage unit 204 is electrically connected between the first power supply terminal Vdd and the eighth node Q8, as shown in FIG. 2B. Alternatively, the storage unit 204 is electrically connected between the first node Q1 and the eighth node Q8, as shown in FIG. 2A, for maintaining the potential of the eighth node Q8.

Alternatively, the storage unit 204 includes a second capacitor C2 connected in series between the first power supply terminal Vdd and the eighth node Q8, as shown in FIGS. 2C and 2E. Alternatively, the second capacitor C2 is connected in series between the first node Q1 and the eighth node Q8, as shown in FIGS. 2D and 2F.

The switching unit includes a first switching unit 2061 and a second switching unit 2062. The first switching unit 2061 is electrically connected between the first power supply terminal Vdd and the sixth node Q6, and the second switching unit 2062 is electrically connected between the seventh node Q7 and the first node Q1, as shown in FIG. 2B. Alternatively, the first switching unit 2061 is electrically connected between the first node Q1 and the sixth node Q6, and the second switching unit 2062 is electrically connected between the seventh node Q7 and the light emitting device D, as shown in FIG. 2A.

Alternatively, the first switching unit 2061 includes a thirteenth transistor T13, a gate of the thirteenth transistor T13 is electrically connected to a light emitting control line EML, and a source and a drain of the thirteenth transistor T13 are electrically connected between the first power supply terminal Vdd and the sixth node Q6, as shown in FIGS. 2C and 2E. Alternatively, the source and drain of the thirteenth transistor T13 are electrically connected between the first node Q1 and the sixth node Q6, as shown in FIGS. 2D and 2F. Compared with a design in which the source and the drain of the thirteenth transistor T13 are electrically connected between the first node Q1 and the sixth node Q6, the source and the drain of the thirteenth transistor T13 are electrically connected between the first power supply terminal Vdd and the sixth node Q6, so that a voltage difference between the gate and the source of the eleventh transistor T11 can be made more stable, thereby facilitating the electrical uniformity design.

The second switching unit 2062 includes a fourteenth transistor T14, where a gate of the fourteenth transistor T14 is electrically connected to the light emitting control line EML, and a source and a drain of the fourteenth transistor T14 are electrically connected between the seventh node Q7 and the first node Q1, as shown in FIGS. 2C and 2E. Alternatively, the source and drain of the fourteenth transistor T14 are electrically connected between the seventh node Q7 and an anode of the light emitting device D, as shown in FIGS. 2D and 2F. The driving current signal Id is generated in a path from the first power supply terminal Vdd to the second power supply terminal Vss via the thirteenth transistor T13, the fourteenth transistor T14, and the ninth transistor T9 under the action of the light emitting control signal Em(n) and the current driving control signal, respectively.

The first reset unit 205 is electrically connected between a first reset line VL and the eighth node Q8, for resetting the eighth node Q8 based on the first reset signal VI transmitted by the first reset line VL. Alternatively, the first reset unit 205 includes a fifteenth transistor T15, where a gate of the fifteenth transistor T15 is electrically connected to a third control line PAL2, a source and a drain of the fifteenth transistor T15 are electrically connected between the first reset line VL and the eighth node Q8, and the fifteenth transistor T15 is configured to transmit the first reset signal VI transmitted by the first reset line VL to the eighth node Q8.

Alternatively, the pixel driving circuit further includes a second reset unit 300 electrically connected to the anode of the light emitting device D for resetting the potential of the anode of the light emitting device D.

Alternatively, as shown in FIGS. 2E-2F, the second reset unit 300 includes a sixteenth transistor T16, where a gate of the sixteenth transistor T16 is electrically connected to the first control line PWL1, and the source and drain of the sixteenth transistor T16 are electrically connected between the first node Q1 and the second power supply terminal Vss.

Alternatively, the first power supply terminal Vdd, the second power supply terminal Vss, the third power supply terminal Switch_L, the fourth power supply terminal Vs, the fifth power supply terminal Switch_H, and the sixth power supply terminal Inv_H are all DC power supply terminals, and the first reset signal VI is a DC signal. A voltage value of the first power supply signal transmitted from the first power supply terminal Vdd is greater than a voltage value of the second power supply signal transmitted from the second power supply terminal Vss, a voltage value of the fifth power supply signal transmitted from the fifth power supply terminal Switch_H is greater than a voltage value of the third power supply signal transmitted from the third power supply terminal Switch_L, and a voltage value of the sixth power supply signal transmitted from the sixth power supply terminal Inv_H is greater than a voltage value of the third power supply signal transmitted from the third power supply terminal Switch_L, so that the pixel driving circuit can operate normally.

Alternatively, the modulation signal Sw is a triangular wave signal. Accordingly, as the modulation signal Sw is changed, a case in which the first data signal Data1 is larger than the modulation signal Sw, or the first data signal Data1 is equal to the modulation signal Sw, or the first data signal Data1 is smaller than the modulation signal Sw may occur. A branch circuit current flowing through the first transistor T1 and the fourth transistor T4 and a branch circuit current flowing through the second transistor T2 and the third transistor T3 are determined by the potentials of the modulation signal Sw and the second node Q2, respectively. Thus, if both the first transistor T1 and the second transistor T2 are P-type transistors, when the potential of the second node Q2 is greater than the modulation signal Sw, the branch circuit current flowing through the first transistor T1 and the fourth transistor T4 is greater than the branch circuit current flowing through the second transistor T2 and the third transistor T3. Since a resistance of a branch circuit where the first transistor T1 and the fourth transistor T4 are located, a resistance of a branch circuit where the second transistor T2 and the third transistor T3 are located, and the third power supply signal transmitted from the third power supply terminal Switch_L are fixed, when the branch circuit current flowing through the first transistor T1 and the fourth transistor T4 is increased, a voltage drop across the source and the drain of the fourth transistor T4 is increased, so that the potential of the fifth node Q5 is increased. The sixth transistor T6 is turned on as the potential of the fifth node Q5 is increased, and the third power supply signal transmitted from the third power supply terminal Switch_L is transmitted to the third node Q3. On the contrary, when the potential of the second node Q2 is less than the modulation signal Sw, the branch circuit current flowing through the first transistor T1 and the fourth transistor T4 are less than the branch circuit current flowing through the second transistor T2 and the third transistor T3. Since the resistance of the branch circuit where the first transistor T1 and the fourth transistor T4 are located, the resistance of the branch circuit where the second transistor T2 and the third transistor T3 are located, and the third power supply signal transmitted from the third power supply terminal Switch_L are fixed, when the branch circuit current flowing through the first transistor T1 and the fourth transistor T4 is decreased, the voltage drop across the source and the drain of the fourth transistor T4 is decreased, so that the potential of the fifth node Q5 is decreased. The seventh transistor T7 is turned on as the potential of the fifth node Q5 is decreased, and the sixth power supply signal transmitted from the sixth power supply terminal Inv_H is transmitted to the third node Q3. Accordingly, if a voltage value of the modulation signal Sw is less than a voltage value of the first data signal Data1 during a first time period, the pulse width of the valid pulse of the driving current signal Id is equal to the first time period.

It should be understood that if both the first transistor T1 and the second transistor T2 are N-type transistors, when the potential of the second node Q2 is less than the modulation signal Sw, the branch circuit current flowing through the first transistor T1 and the fourth transistor T4 are greater than the branch circuit current flowing through the second transistor T2 and the third transistor T3, so that the potential of the fifth node Q5 is increased. The sixth transistor T6 is turned on as the potential of the fifth node Q5 is increased, and the third power supply signal transmitted from the third power supply terminal Switch_L is transmitted to the third node Q3. When the potential of the second node Q2 is greater than the modulation signal Sw, the branch circuit current flowing through the first transistor T1 and the fourth transistor T4 are less than the branch circuit current flowing through the second transistor T2 and the third transistor T3, so that the potential of the fifth node Q5 is decreased, the seventh transistor T7 is turned on as the potential of the fifth node Q5 is decreased, and the sixth power supply signal transmitted from the sixth power supply terminal Inv_H is transmitted to the third node Q3. Accordingly, if the voltage value of the modulation signal Sw is greater than the voltage value of the first data signal Data1 in a second time period, the pulse width of the valid pulse of the driving current signal Id is equal to the second time period.

Alternatively, in a high gray scale state, the driving current signal Id has a plurality of first valid pulses. In a low gray scale state, the driving current signal Id has a plurality of second valid pulses. The pulse width of the first valid pulse is greater than the pulse width of the second valid pulse, and the amplitude of the first valid pulse is less than the amplitude of the second valid pulse, so that the light emitting duration of the light emitting device D in the corresponding high gray scale state is longer than the light emitting duration of the light emitting device D in the corresponding low gray scale state, and the light emitting brightness of the light emitting device D in the corresponding high gray scale state is less than the light emitting brightness of the light emitting device D in the corresponding low gray scale state, thereby improving the problems of lower light emitting efficiency and worse brightness uniformity in the low gray scale display.

Alternatively, all of the first transistor to the sixteenth transistor T1-T16 are P-type transistors or N-type transistors. All of the first transistor to the sixteenth transistor T1-T16 are silicon transistors or oxide transistors.

Figure 3:
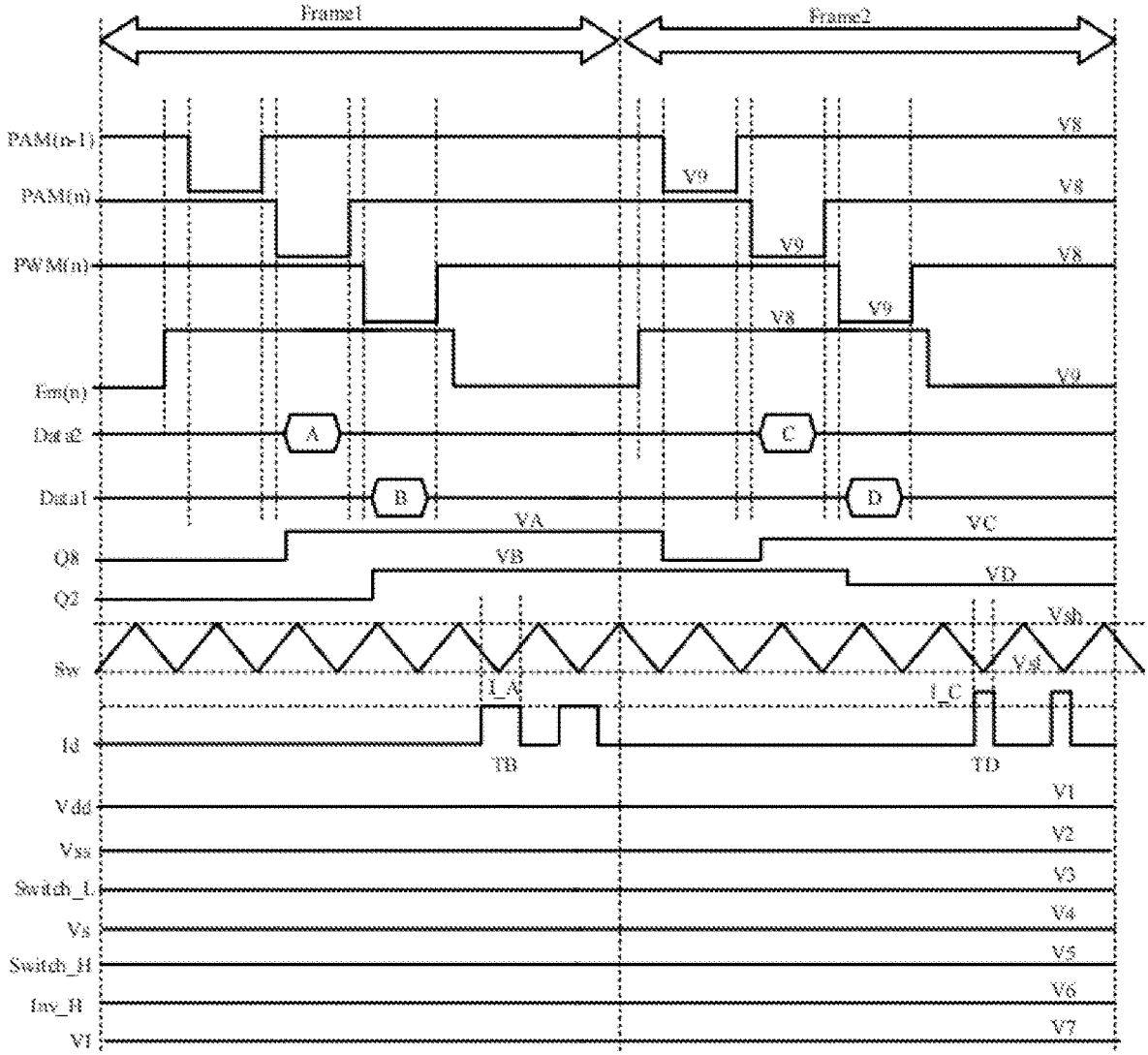
FIG. 3 is a driving timing diagram according to an embodiment of the present application.

FIG. 3 is a driving timing diagram according to an embodiment of the present application. An example in which all of the first transistor T1, the second transistor T2, and the seventh transistor to the fifteenth transistor T7-T15 are P-type transistors, and all of the third transistor to the sixth transistor T3-T6 are N-type transistors is taken to illustrate an operation principle of the pixel driving circuit shown in FIG. 2C. V1-V6 correspond to voltage values of the first power supply signal to the sixth power supply signal, respectively, and V7 represents a voltage value of the first reset signal VI; V8 represents a high potential and V9 represents a low potential; TB and TD both represent pulse widths; Vsh represents the maximum value of the modulation signal Sw, and Vs1 represents the minimum value of the modulation signal Sw.

In a first frame Frame1, when a third control signal PAM(n−1) transmitted by the third control line PAL2 is at a low potential, and all of a second control signal PAM(n) transmitted by the second control line PAL1, a first control signal PWM(n) transmitted by the first control line PWL1, and a light emitting control signal Em(n) transmitted by the light emitting control line EML are at high potentials, the fifteenth transistor T15 is turned on, and the first reset signal VI transmitted by the first reset line VL is transmitted to the eighth node Q8 to reset the eighth node Q8 with the first reset signal VI.

When the second control signal PAM(n) is at a low potential, and all of the third control signal PAM(n−1), the first control signal PWM(n), and the light emitting control signal Em(n) are at high potentials, the tenth transistor T10, the eleventh transistor T11, and the twelfth transistor T12 are all turned on, and the second data signal Data2 transmitted by the second data line DL2 (i.e., the second data signal Data2 correspondingly having the first voltage value VA) is transmitted to the eighth node Q8 through the tenth transistor T10, the eleventh transistor T11, and the twelfth transistor T12.

When the first control signal PWM(n) is at a low potential, and all of the third control signal PAM(n−1), the second control signal PAM(n), and the light emitting control signal Em(n) are at high potentials, the eighth transistor T8 is turned on, and the first data signal Data1 transmitted by the first data line DL1 (the first data signal Data1 correspondingly having the second voltage value VB) is transmitted to the second node Q2.

When the light emitting control signal Em(n) is at a low potential, and all of the third control signal PAM(n−1), the second control signal PAM(n), and the first control signal PWM(n) are at high potentials, if the potential of the second node Q2 is greater than the modulation signal Sw, the branch circuit current flowing through the first transistor T1 and the fourth transistor T4 are greater than the branch circuit current flowing through the second transistor T2 and the third transistor T3. Since the resistance of the branch circuit where the first transistor T1 and the fourth transistor T4 are located, the resistance of the branch circuit where the second transistor T2 and the third transistor T3 are located, and the third power supply signal transmitted from the third power supply terminal Switch_L are fixed, when the branch circuit current flowing through the first transistor T1 and the fourth transistor T4 is increased, the voltage drop across the source and the drain of the fourth transistor T4 is increased, so that the potential of the fifth node Q5 is increased. The sixth transistor T6 is turned on as the potential of the fifth node Q5 is increased, and the third power supply signal transmitted from the third power supply terminal Switch_L is transmitted to the third node Q3. The ninth transistor T9 is turned on, so that the driving current signal Id has a valid pulse, and the light emitting device D enters a light emitting state within a time period corresponding to the pulse width TB of the valid pulse of the driving current signal Id. When the potential of the second node Q2 is less than the modulation signal Sw, the branch circuit current flowing through the first transistor T1 and the fourth transistor T4 are less than the branch circuit current flowing through the second transistor T2 and the third transistor T3. Since the resistance of the branch circuit where the first transistor T1 and the fourth transistor T4 are located, the resistance of the branch circuit where the second transistor T2 and the third transistor T3 are located, and the third power supply signal transmitted from the third power supply terminal Switch_L are fixed, when the branch circuit current flowing through the first transistor T1 and the fourth transistor T4 is decreased, the voltage drop across the source and the drain of the fourth transistor T4 is decreased, so that the potential of the fifth node Q5 is decreased. The seventh transistor T7 is turned on as the potential of the fifth node Q5 is decreased, and the sixth power supply signal transmitted from the sixth power supply terminal Inv_H is transmitted to the third node Q3. The ninth transistor T9 is turned off, so that the driving current signal Id has an invalid pulse, and the light emitting device D enters a non-light emitting state within a period corresponding to the invalid pulse of the driving current signal Id. Until the light emitting control signal Em(n) is changed from the low potential to the high potential, the light emitting state of the light emitting device D enters a cycle state based on a difference between the modulation signal Sw and the potential of the second node Q2.

In a second frame Frame2, when the third control signal PAM(n−1) is at a low potential, and all of the second control signal PAM(n), the first control signal PWM(n), and the light emitting control signal Em(n) are at high potentials, the fifteenth transistor T15 is turned on, and the first reset signal transmitted by the first reset line is transmitted to the eighth node Q8 to reset the eighth node Q8 with the first reset signal.

When the second control signal PAM(n) is at a low potential, and all of the third control signal PAM(n−1), the first control signal PWM(n), and the light emitting control signal Em(n) are at high potentials, the tenth transistor T10, the eleventh transistor T11, and the twelfth transistor T12 are all turned on, and the second data signal Data2 transmitted by the second data line DL2 (i.e., the second data signal Data2 correspondingly having a third voltage value VC different from the first voltage value VA) is transmitted to the eighth node Q8 through the tenth transistor T10, the eleventh transistor T11, and the twelfth transistor T12.

When the first control signal PWM(n) is at a low potential, and all of the third control signal PAM(n−1), the second control signal PAM(n), and the light emitting control signal Em(n) are at high potentials, the eighth transistor T8 is turned on, and the first data signal Data1 transmitted by the first data line DL1 (the first data signal Data1 correspondingly having a fourth voltage value VD different from the second voltage value VB) is transmitted to the second node Q2.

When the light emitting control signal Em(n) is at a low potential, and all of the third control signal PAM(n−1), the second control signal PAM(n) and the first control signal PWM(n) are at high potentials, if the potential of the second node Q2 is greater than the modulation signal Sw, the branch circuit current flowing through the first transistor T1 and the fourth transistor T4 is greater than the branch circuit current flowing through the second transistor T2 and the third transistor T3, so that the potential of the fifth node Q5 is increased. The sixth transistor T6 is turned on as the potential of the fifth node Q5 is increased, and the third power supply signal transmitted from the third power supply terminal Switch_L is transmitted to the third node Q3. The ninth transistor T9 is turned on, so that the driving current signal Id has a valid pulse, and the light emitting device D enters the light emitting state within a period corresponding to the pulse width TD of the valid pulse of the driving current signal Id. When the potential of the second node Q2 is less than the modulation signal Sw, the branch circuit current flowing through the first transistor T1 and the fourth transistor T4 are less than the branch circuit current flowing through the second transistor T2 and the third transistor T3, so that the potential of the fifth node Q5 is decreased, the seventh transistor T7 is turned on as the potential of the fifth node Q5 is decreased, and the sixth power supply signal transmitted from the sixth power supply terminal Inv_H is transmitted to the third node Q3. The ninth transistor T9 is turned off, so that the driving current signal Id has an invalid pulse, and the light emitting device D enters a non-light emitting state within a period corresponding to the invalid pulse of the driving current signal Id. Until the light emitting control signal Em(n) is changed from the low potential to the high potential, the light emitting state of the light emitting device D enters a cycle state based on a difference between the modulation signal Sw and the potential of the second node Q2.

By controlling the voltage value of the first data signal Data1 transmitted by the first data line DL1 and the voltage value of the second data signal Data2 transmitted by the second data line DL2 in different frames, it is possible to make the valid pulses of the driving current signal Id have different pulse widths and amplitudes in the different frames, so that the light emitting device D has different light emitting duration and different light emitting brightness in correspondingly different gray scale states, whereby it is possible to realize a gray-scale difference of display.

Alternatively, the gray scale state corresponding to the first frame Frame1 is a high gray scale state, the gray scale state corresponding to the second frame Frame2 is a low gray scale state, and the driving current signal Id has a plurality of first valid pulses in the first frame Frame1 and a plurality of second valid pulses in the second frame Frame2. If the pulse width of the first valid pulse is TB, the pulse width of the second valid pulse is TD, the amplitude of the first valid pulse is I_A, and the amplitude of the second valid pulse is I_C, then TB>TD, and I_A<I_C, so that the light emitting duration of the light emitting device D in the corresponding high gray scale state is longer than the light emitting duration of the light emitting device D in the corresponding low gray scale state, and the light emitting brightness of the light emitting device D in the corresponding high gray scale state is less than the light emitting brightness of the light emitting device D in the corresponding low gray scale state. Since the light emitting brightness of the light emitting device D is positively proportional to the product of time and the driving current Id, the light emitting duration of the light emitting device D in the corresponding high gray scale state is longer than the light emitting duration of the light emitting device D in the corresponding low gray scale state, and the light emitting brightness of the light emitting device D in the corresponding high gray scale state is less than the light emitting brightness of the light emitting device D in the corresponding low gray scale state. The brightness difference between the high gray scale state and the low gray scale state can be adjusted, thereby improving the problems of lower light emitting efficiency and worse brightness uniformity in the low gray scale display.

Further, since the light emitting device D can enter a cycle state having the light emitting state and the non-light emitting state based on the difference between the modulation signal Sw and the potential of the first node Q1 in a valid phase of the light emitting control signal Em(n), a problem of brightness attenuation of the light emitting device D in continuously emitting light for a long period of time can be improved, and the flicker problem can also be improved. The valid phase of the light emitting control signal Em(n) refers to a phase in which the thirteenth transistor T13 and the fourteenth transistor T14 can be turned on.

It should be understood that a duty cycle of the first control signal PWM(n) may be adjusted in correspondingly different gray scale states to correspondingly adjust valid pulse action time of the driving current signal Id. For example, the duty cycle of the first control signal PWM(n) is set higher in a correspondingly high gray scale stage, to increase valid pulse action time of the driving current signal Id, and the duty cycle of the first control signal PWM(n) is set lower in a correspondingly low gray scale stage, to decrease valid pulse action time of the driving current signal Id. It should be understood that the frequency and amplitude of the modulated signal Sw can be set according to actual requirements.

The sixteenth transistor T16 is turned on in a phase in which the first control line PWL1 controls the eighth transistor T8 to be turned on, so as to transmit the second power supply signal transmitted from the second power supply terminal Vss to the anode of the light-emitting device D so as to reset the potential of the anode of the light emitting device D.

The operation principle of the pixel driving circuit shown in FIGS. 2D-2F is similar to that of the pixel driving circuit shown in FIG. 2C, which is not repeatedly described herein again.

Another embodiment of the present application further provides a display panel, including a pixel driving circuit of any of the foregoings.

Figure 4:
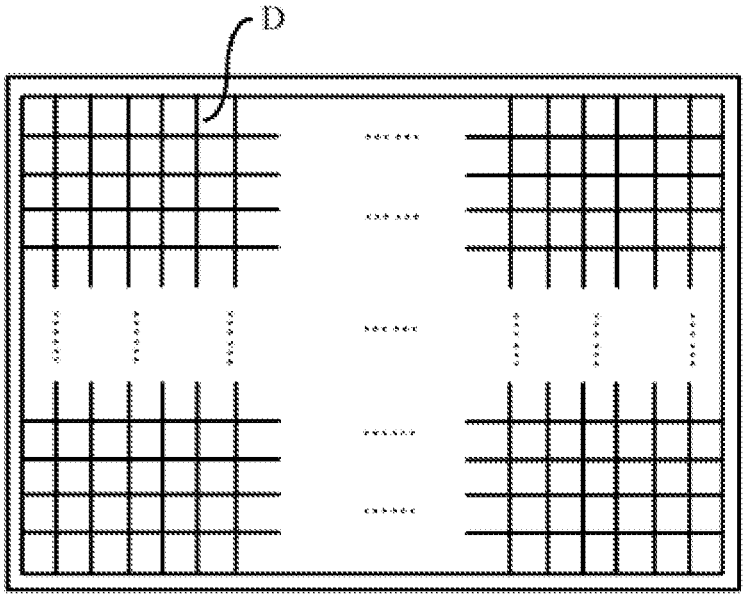
FIG. 4 is a schematic diagram of a structure of a display panel according to an embodiment of the present application.

FIG. 4 is a schematic diagram of a structure of a display panel according to an embodiment of the present application. The present invention further provides a display panel, including a plurality of pixel driving circuits and a plurality of light emitting devices D, where the plurality of pixel driving circuits and the plurality of light emitting devices D are electrically connected.

Alternatively, the anode of the light emitting device D is electrically connected to the first power supply terminal Vdd, and the pixel driving circuit is electrically connected between a cathode of respective one of the light emitting devices D and the second power supply terminal Vss. Alternatively, the cathode of the light emitting device D is electrically connected to the second power supply terminal Vss, and the pixel driving circuit is electrically connected between the anode of respective one of the light emitting devices D and the first power supply terminal Vdd. Alternatively, the light emitting device D includes an organic light emitting diode, a sub-millimeter light emitting diode, and a micro light emitting diode.

FIGS. 5A-5D are schematic diagrams of structures of pixel driving circuits according to embodiments of the present application. At least one pixel driving circuit includes: a first transistor T1, a second transistor T2, a third transistor T3, a fourth transistor T4, a fifth transistor T5, a sixth transistor T6, a seventh transistor T7, an eighth transistor T8, a ninth transistor T9, a tenth transistor T10, an eleventh transistor T11, a twelfth transistor T12, a thirteenth transistor T13, a fourteenth transistor T14, a fifteenth transistor T15, a first capacitor C1, and a second capacitor C2.

The first capacitor C1 is connected in series between a second node Q2 and a second power supply terminal Vss. A gate of the first transistor T1 is electrically connected to a modulation signal source Sweep, and a source and a drain of the first transistor T1 are electrically connected between a fourth node Q4 and a fifth node Q5. A gate of the second transistor T2 is electrically connected to the second node Q2, and one of a source and a drain of the second transistor T2 is electrically connected to the fourth node Q4. A gate of the third transistor T3 is electrically connected to another one of the source and the drain of the second transistor T2, and a source and a drain of the third transistor T3 are electrically connected between the another one of the source and the drain of the second transistor T2 and the third power supply terminal Switch_L. A gate of the fourth transistor T4 is electrically connected to the another one of the source and the drain of the second transistor T2, and a source and a drain of the fourth transistor T4 are electrically connected between the fifth node Q5 and the third power supply terminal Switch_L. Agate of the fifth transistor T5 is electrically connected to a fourth power supply terminal Vs, and a source and a drain of the fifth transistor T5 are electrically connected between the fifth power supply terminal Switch_H and the fourth node Q4. A gate of the sixth transistor T6 is electrically connected to the fifth node Q5, and a source and a drain of the sixth transistor T6 are electrically connected between the third power supply terminal Switch_L and the third node Q3. A gate of the seventh transistor T7 is electrically connected to the fifth node Q5, and a source and a drain of the seventh transistor T7 are electrically connected between the sixth power supply terminal Inv_H and the third node Q3. A gate of the eighth transistor T8 is electrically connected to a first control line PWL1, and a source and a drain of the eighth transistor T8 are electrically connected between the second node Q2 and a first data line DL1.

Figure 5A:
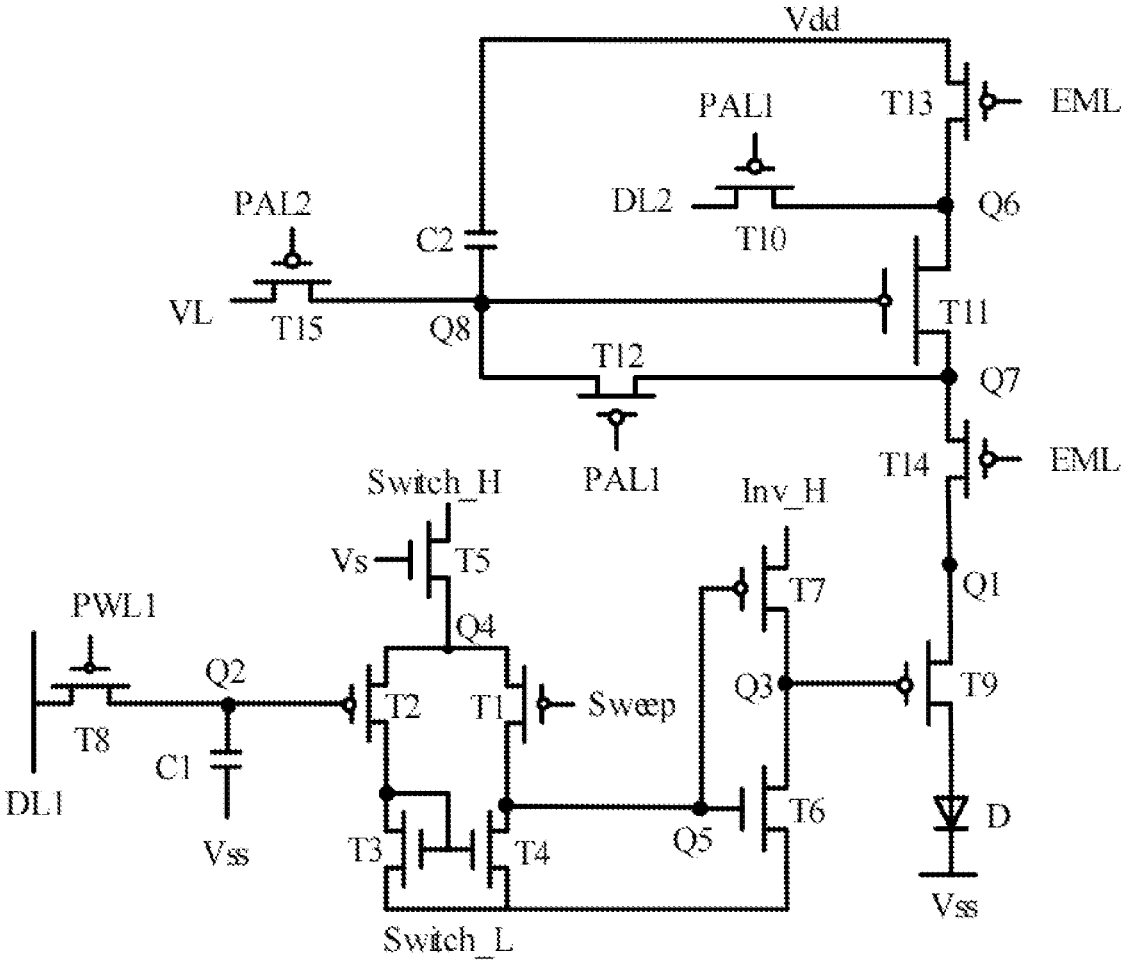
FIG. 5A is a schematic diagram of a structure of a pixel driving circuit according to an embodiment of the present application.
Figure 5B:
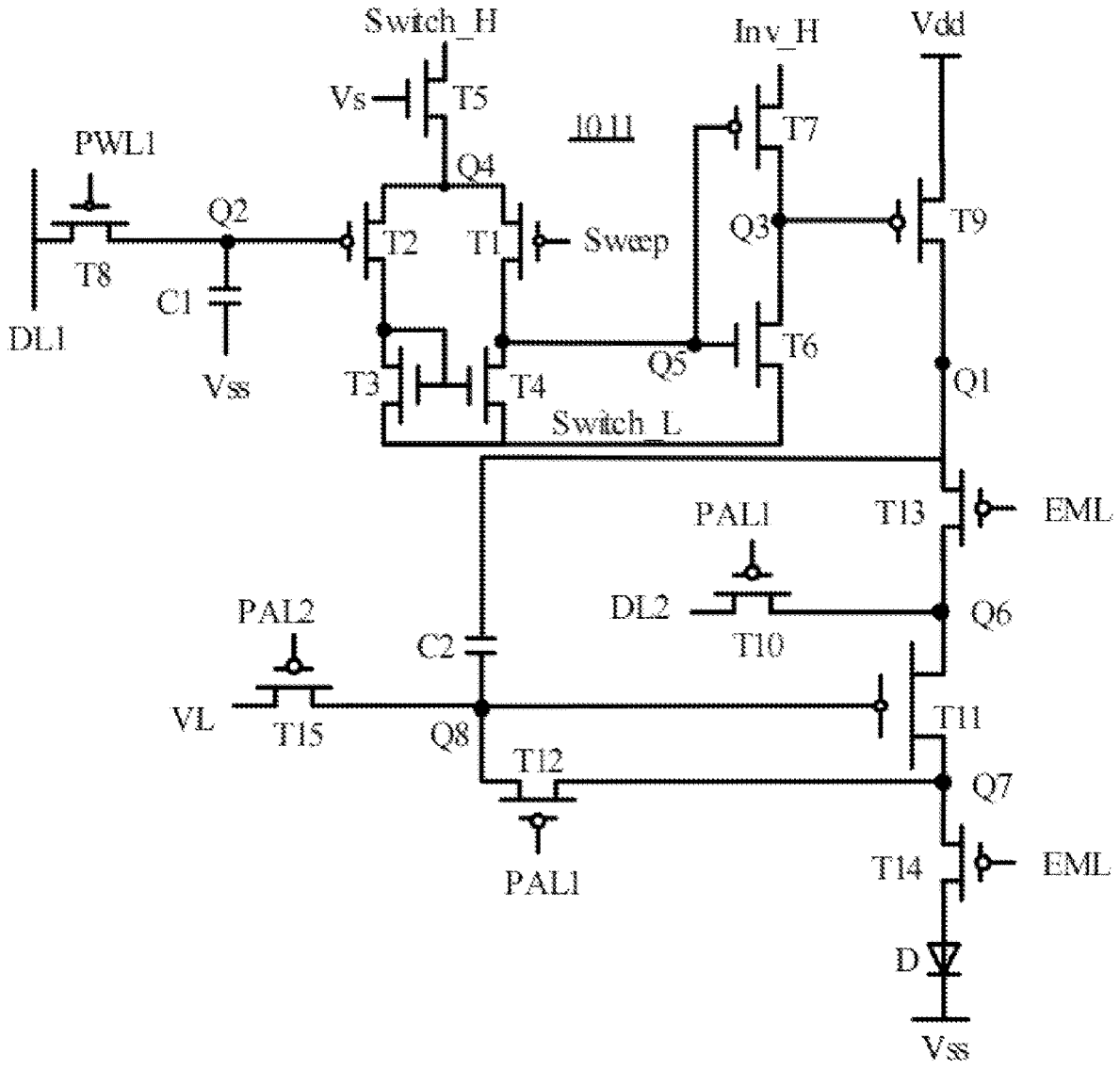
FIG. 5B is a schematic diagram of a structure of a pixel driving circuit according to an embodiment of the present application.
Figure 5C:
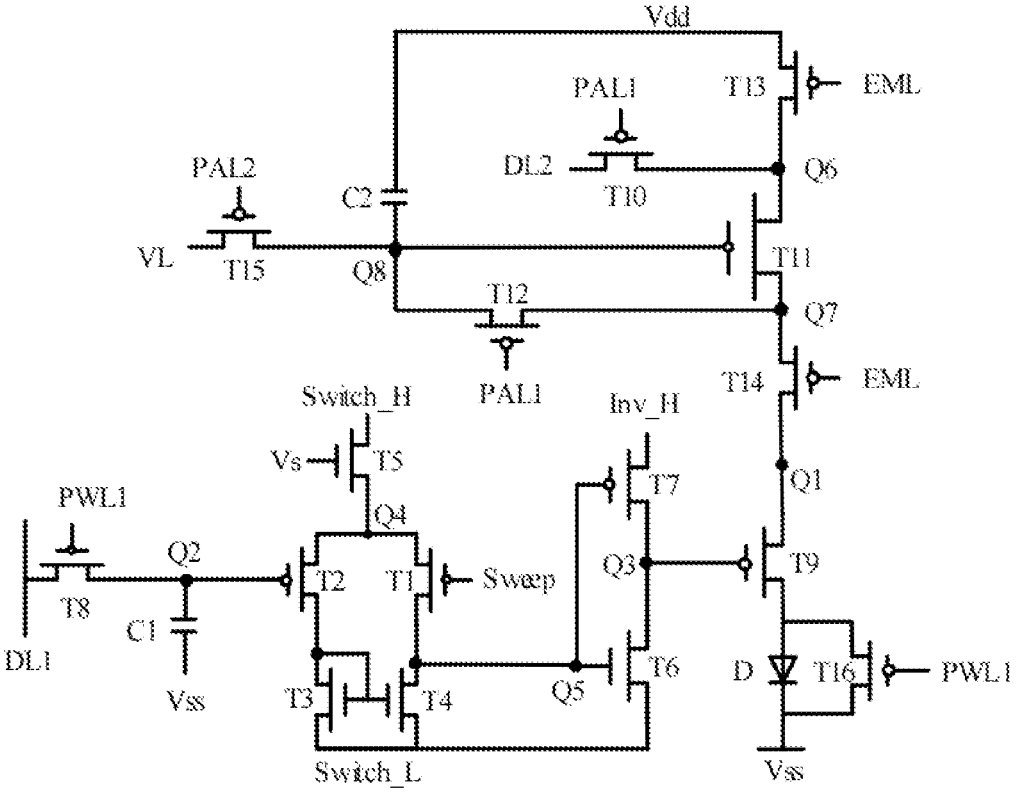
FIG. 5C is a schematic diagram of a structure of a pixel driving circuit according to an embodiment of the present application.

Alternatively, a gate of the ninth transistor T9 is electrically connected to the third node Q3, and a source and a drain of the ninth transistor T9 are electrically connected between the first node Q1 and respective one of the light emitting devices D, as shown in FIGS. 5A and 5C. Alternatively, the source and drain of the ninth transistor T9 are electrically connected between the first node Q1 and the first power supply terminal Vdd, as shown in FIGS. 5B and 5D.

A gate of the tenth transistor T10 is electrically connected to a second control line PALL and a source and a drain of the tenth transistor T10 are electrically connected between a second data line DL2 and the sixth node Q6. A gate of the eleventh transistor T11 is electrically connected to the eighth node Q8, and a source and a drain of the eleventh transistor T11 are electrically connected between the sixth node Q6 and the seventh node Q7. A gate of the twelfth transistor T12 is electrically connected to the second control line PAL1, and a source and a drain of the twelfth transistor T12 are electrically connected between the seventh node Q7 and the eighth node Q8. A gate of the fifteenth transistor T15 is electrically connected to a third control line PAL2, and a source and a drain of the fifteenth transistor T15 are electrically connected between the first reset line VL and the eighth node Q8.

Alternatively, a gate of the thirteenth transistor T13 and a gate of the fourteenth transistor T14 are both electrically connected to a light emitting control line EML, a source and a drain of the thirteenth transistor T13 are electrically connected between the first power supply terminal Vdd and the sixth node Q6, a source and a drain of the fourteenth transistor T14 are electrically connected between the seventh node Q7 and the first node Q1, and the second capacitor C2 is connected in series between the first power supply terminal Vdd and the eighth node Q8, as shown in FIGS. 5A and 5C. Alternatively, the source and the drain of the thirteenth transistor T13 are electrically connected between the first node Q1 and the sixth node Q6, the source and the drain of the fourteenth transistor T14 are electrically connected between the seventh node Q7 and respective one of the light emitting devices D, and the second capacitor C2 is connected in series between the first node Q1 and the eighth node Q8, as shown in FIGS. 5B and 5D.

Figure 5D:
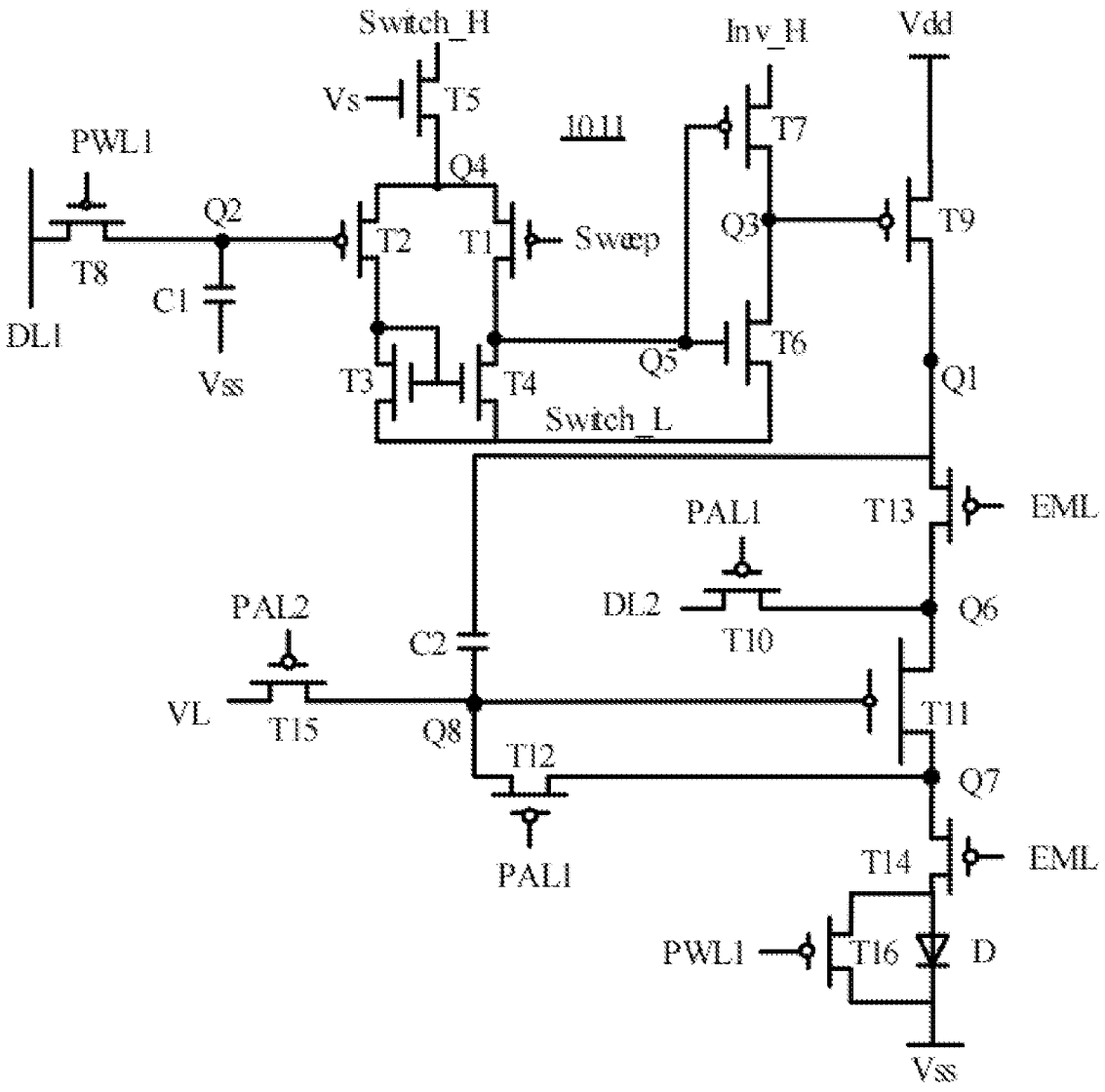
FIG. 5D is a schematic diagram of a structure of a pixel driving circuit according to an embodiment of the present application.

Alternatively, the at least one of the pixel driving circuits further includes a sixteenth transistor T16, where a gate of the sixteenth transistor T16 is electrically connected to the first control line PWL1, and a source and a drain of the sixteenth transistor T16 are electrically connected between the first node Q1 and the second power supply terminal Vss, as shown in FIGS. 5C-5D.

Alternatively, the plurality of light emitting devices D includes a first light emitting device, a second light emitting device having different light emitting colors, and a third light emitting device, and the plurality of pixel driving circuits include a first pixel driving circuit for driving the first light emitting device to emit light, a second pixel driving circuit for driving the second light emitting device to emit light, and a third pixel driving circuit for driving the third light emitting device to emit light. By making the first data signal and the second data signal transmitted by the first data line DL1 and the second data line DL2 electrically connected to the first pixel driving circuit, the second pixel driving circuit, and the third pixel driving circuit have different voltage values, respectively, it is possible to make different light emitting time and different light emitting brightness of the first light emitting device, the second light emitting device, and the third light emitting device in the same gray scale state, thereby realizing a gray scale difference of display, and further improving the problems of lower light emitting efficiency and worse brightness uniformity in the low gray scale display.

Another embodiment of the present application further provides a display device, including a driving circuit of any of the foregoings and a display panel of any of the foregoings. As can be understood, the display device includes a movable display device (e.g., a notebook computer, a mobile phone, etc.), a fixed terminal (e.g., a desktop computer, a television, etc.), a measuring device (e.g., a sport bracelet, a thermometer, etc.), or the like.

A specific example is used herein to describe a principle and an implementation of the present application. The description of the foregoing embodiments is merely used to help understand a method and a core idea of the present application. In addition, a person skilled in the art may make changes in a specific implementation manner and an application scope according to an idea of the present application. In conclusion, content of this specification should not be construed as a limitation on the present application.

What is claimed is:

1. A pixel driving circuit, comprising:

a pulse width modulation module electrically connected to a first data line, a first node, and a modulation signal source, and configured to control a pulse width of a valid pulse of a driving current signal for driving a light emitting device to emit light; and an amplitude regulating module electrically connected to a second data line and the first node, and configured to control an amplitude of the valid pulse of the driving current signal;

wherein, the valid pulse of the driving current signal has different pulse widths and different amplitudes in correspondingly different gray scale states, wherein the amplitude regulating module is electrically connected between a first power supply terminal and the first node, the pulse width modulation module is electrically connected between the first node and an anode of the light emitting device, and a cathode of the light emitting device is electrically connected to a second power supply terminal.

2. The pixel driving circuit of claim 1, wherein a modulation signal generated by the modulation signal source is a triangular wave signal.

3. The pixel driving circuit of claim 2, wherein a voltage value of the modulation signal is less than a voltage value of a first data signal transmitted by the first data line during a first time period;

wherein the pulse width is equal to the first time period.

4. The pixel driving circuit of claim 1, wherein, in a high gray scale state, the driving current signal has a plurality of first valid pulses; and in a low gray scale state, the driving current signal has a plurality of second valid pulses;

wherein, a pulse width of each of the first valid pulses is greater than a pulse width of each of the second valid pulses and an amplitude of each of the first valid pulses is less than an amplitude of each of the second valid pulses.

5. The pixel driving circuit of claim 1, wherein the pulse width modulation module comprises:

a first data writing unit electrically connected to the first data line and a second node, and configured to transmit a first data signal transmitted by the first data line to the second node;

a data conversion unit electrically connected to the second node and a third node, and configured to generate a current driving control signal and transmitting the current driving control signal to the third node; and a first current driving unit electrically connected to the third node, the first node, and the light emitting device, and configured to control the pulse width of the valid pulse of the driving current signal.

6. The pixel driving circuit of claim 5, wherein the data conversion unit comprises:

a first transistor, wherein a gate of the first transistor is electrically connected to the modulation signal source, and a source and a drain of the first transistor are electrically connected between a fourth node and a fifth node;

a second transistor, wherein a gate of the second transistor is electrically connected to the second node, and one of a source and a drain of the second transistor is electrically connected to the fourth node;

a third transistor, wherein a gate of the third transistor is electrically connected to another one of the source and the drain of the second transistor, and a source and a drain of the third transistor are electrically connected between the another one of the source and the drain of the second transistor and a third power supply terminal;

a fourth transistor, wherein a gate of the fourth transistor is electrically connected to the another one of the source and the drain of the second transistor, and a source and a drain of the fourth transistor are electrically connected between the fifth node and the third power supply terminal;

a fifth transistor, wherein a gate of the fifth transistor is electrically connected to a fourth power supply terminal, and a source and a drain of the fifth transistor are electrically connected between a fifth power supply terminal and the fourth node;

a sixth transistor, wherein a gate of the sixth transistor is electrically connected to the fifth node, and a source and a drain of the sixth transistor are electrically connected between the third power supply terminal and the third node; and a seventh transistor, wherein a gate of the seventh transistor is electrically connected to the fifth node, and a source and a drain of the seventh transistor are electrically connected between a sixth power supply terminal and the third node;

wherein a voltage value of a first power supply signal transmitted by the first power supply terminal is greater than a voltage value of a second power supply signal transmitted by the second power supply terminal, a voltage value of a third power supply signal transmitted by the third power supply terminal is less than a voltage value of a fifth power supply signal transmitted by the fifth power supply terminal, and a voltage value of a sixth power supply signal transmitted by the sixth power supply terminal is greater than a voltage value of the third power supply signal transmitted by the third power supply terminal.

7. The pixel driving circuit of claim 6, wherein, the fifth transistor is a P-type transistor.

8. The pixel driving circuit of claim 5, wherein the first data writing unit includes an eighth transistor and a first capacitor; a gate of the eighth transistor is electrically connected to a first control line, and a source and a drain of the eighth transistor are electrically connected between the second node and the first data line; and the first capacitor is connected in series between the second node and the second power supply terminal; and the first current driving unit includes a ninth transistor, wherein a gate of the ninth transistor is electrically connected to the third node, and a source and a drain of the ninth transistor are electrically connected between the first node and the light emitting device.

9. The pixel driving circuit of claim 1, wherein the amplitude regulating module comprises:

a second data writing unit electrically connected to the second data line and a sixth node, and configured to transmit a second data signal transmitted by the second data line to the sixth node;

a second current driving unit electrically connected to the sixth node, a seventh node, and an eighth node, and configured to control the amplitude of the valid pulse of the driving current signal;

a threshold voltage compensation unit electrically connected to the seventh node and the eighth node;

a storage unit electrically connected between the first power supply terminal and the eighth node;

a first switching unit electrically connected between the first power supply terminal and the sixth node;

a second switching unit electrically connected between the seventh node and the first node; and a first reset unit electrically connected between a first reset line and the eighth node.

10. The pixel driving circuit of claim 9, wherein, the second data writing unit includes a tenth transistor, where a gate of the tenth transistor is electrically connected to a second control line, and a source and a drain of the tenth transistor are electrically connected between the second data line and the sixth node;

the second current driving unit includes an eleventh transistor, wherein a gate of the eleventh transistor is electrically connected to the eighth node, and a source and a drain of the eleventh transistor are electrically connected between the sixth node and the seventh node;

the storage unit includes a second capacitor connected in series between the first power supply terminal and the eighth node;

the threshold voltage compensation unit includes a twelfth transistor, wherein a gate of the twelfth transistor is electrically connected to the second control line, and a source and a drain of the twelfth transistor are electrically connected between the seventh node and the eighth node;

the first switching unit includes a thirteenth transistor, wherein a gate of the thirteenth transistor is electrically connected to a light emitting control line, and a source and a drain of the thirteenth transistor are electrically connected between the first power supply terminal and the sixth node;

the second switching unit includes a fourteenth transistor, wherein a gate of the fourteenth transistor is electrically connected to the light emitting control line, and a source and a drain of the fourteenth transistor is electrically connected between the seventh node and the first node; and the first reset unit includes a fifteenth transistor, wherein a gate of the fifteenth transistor is electrically connected to a third control line, and a source and a drain of the fifteenth transistor are electrically connected between the first reset line and the eighth node.

11. The pixel driving circuit of claim 1, further comprising:

a second reset unit including a sixteenth transistor, where a gate of the sixteenth transistor is electrically connected to the first control line, and a source and a drain of the sixteenth transistor are electrically connected between the first node and a second power supply terminal.

12. A pixel driving circuit, comprising:

a pulse width modulation module electrically connected to a first data line, a first node, and a modulation signal source, and configured to control a pulse width of a valid pulse of a driving current signal for driving a light emitting device to emit light; and an amplitude regulating module electrically connected to a second data line and the first node, and configured to control an amplitude of the valid pulse of the driving current signal;

wherein, the valid pulse of the driving current signal has different pulse widths and different amplitudes in correspondingly different gray scale states, wherein the pulse width modulation module is electrically connected between a first power supply terminal and the first node, the amplitude modulation module is electrically connected between the first node and an anode of the light emitting device, and a cathode of the light emitting device is electrically connected to a second power supply terminal.

13. A display panel, comprising a plurality of pixel driving circuits and a plurality of light emitting devices, wherein the plurality of pixel driving circuits and the plurality of light emitting devices are electrically connected, and at least one of the pixel driving circuits comprises:

a first transistor, wherein a gate of the first transistor is electrically connected to the modulation signal source, and a source and a drain of the first transistor are electrically connected between a fourth node and a fifth node;

a second transistor, wherein a gate of the second transistor is electrically connected to a second node, and one of a source and a drain of the second transistor is electrically connected to the fourth node;

a third transistor, wherein a gate of the third transistor is electrically connected to another one of the source and the drain of the second transistor, and a source and a drain of the third transistor are electrically connected between the another one of the source and the drain of the second transistor and a third power supply terminal;

a fourth transistor, wherein a gate of the fourth transistor is electrically connected to the another one of the source and the drain of the second transistor, and a source and a drain of the fourth transistor are electrically connected between the fifth node and the third power supply terminal;

a fifth transistor, wherein a gate of the fifth transistor is electrically connected to the fourth power supply terminal, and a source and a drain of the fifth transistor are electrically connected between a fifth power supply terminal and the fourth node;

a sixth transistor, wherein a gate of the sixth transistor is electrically connected to the fifth node, and a source and a drain of the sixth transistor are electrically connected between a third power supply terminal and a third node;

a seventh transistor, wherein a gate of the seventh transistor is electrically connected to the fifth node, and a source and a drain of the seventh transistor are electrically connected between a sixth power supply terminal and the third node;

an eighth transistor, wherein a gate of the eighth transistor is electrically connected to a first control line, and a source and a drain of the eighth transistor are electrically connected between the second node and a first data line;

a ninth transistor, wherein a gate of the ninth transistor is electrically connected to the third node, and a source and a drain of the ninth transistor are electrically connected between a first node and the respective one of the light emitting devices;

a tenth transistor, wherein a gate of the tenth transistor is electrically connected to a second control line, and a source and a drain of the tenth transistor are electrically connected between a second data line and a sixth node;

an eleventh transistor, wherein a gate of the eleventh transistor is electrically connected to an eighth node, and a source and a drain of the eleventh transistor are electrically connected between the sixth node and a seventh node;

a twelfth transistor, wherein a gate of the twelfth transistor is electrically connected to the second control line, and a source and a drain of the twelfth transistor are electrically connected between the seventh node and the eighth node;

a thirteenth transistor, wherein a gate of the thirteenth transistor is electrically connected to a light emitting control line, and a source and a drain of the thirteenth transistor is electrically connected between a first power supply terminal and the sixth node;

a fourteenth transistor, wherein a gate of the fourteenth transistor is electrically connected to the light emitting control line, and a source and a drain of the fourteenth transistor is electrically connected between the seventh node and the first node;

a fifteenth transistor, wherein a gate of the fifteenth transistor is electrically connected to a third control line, and a source and a drain of the fifteenth transistor are electrically connected between a first reset line and the eighth node;

a first capacitor connected in series between the second node and a second power supply terminal; and a second capacitor connected in series between the first power supply terminal and the eighth node.

14. The display panel of claim 13, wherein at least one of the pixel driving circuits further comprises:

a sixteenth transistor, wherein a gate of the sixteenth transistor is electrically connected to the first control line, and a source and a drain of the sixteenth transistor are electrically connected between the first node and a second power supply terminal.

* * * * *